US007000825B2

(12) United States Patent
Alexander et al.

(10) Patent No.: US 7,000,825 B2
(45) Date of Patent: Feb. 21, 2006

(54) FOOD ENCLOSING CONTAINER WITH REBONDABLE RIM AND LIQUID ABSORPTION AND BARRIER LAYERS

(75) Inventors: Garold W. Alexander, Lewis Center, OH (US); Benjamin K. Hoblet, Powell, OH (US); Erik A. O'Neil, Powell, OH (US); Scott F. Rechel, Worthington, OH (US); John Harvey, Atlanta, GA (US)

(73) Assignee: Rogar Capital Corporation, Lewis Center, OH (US)

( * ) Notice: Subject to any disclaimer, the term of this patent is extended or adjusted under 35 U.S.C. 154(b) by 151 days.

(21) Appl. No.: 10/786,432

(22) Filed: Feb. 25, 2004

(65) Prior Publication Data

US 2005/0184141 A1 Aug. 25, 2005

(51) Int. Cl.
*B65D 1/34* (2006.01)

(52) U.S. Cl. ..... 229/407; 229/123.1; 229/125.25; 229/406; 229/906; 229/939

(58) Field of Classification Search ..... 229/123.1, 229/125.25, 406, 407, 906, 939
See application file for complete search history.

(56) References Cited

U.S. PATENT DOCUMENTS 2,028,276 A * 1/1936 Evans ..... 229/109
3,040,949 A * 6/1962 Foote ..... 229/407
3,308,006 A * 3/1967 Kresse et al. ..... 229/5.85
3,792,809 A * 2/1974 Schneider et al. ..... 229/939
3,834,606 A * 9/1974 Andersson ..... 229/406
3,938,726 A * 2/1976 Holden et al. ..... 229/406
3,938,729 A * 2/1976 Smith ..... 229/939
4,441,626 A 4/1984 Hall
4,489,120 A * 12/1984 Hollinger, Jr. ..... 428/182
4,702,377 A * 10/1987 Grone ..... 229/407
4,804,137 A * 2/1989 Harby ..... 229/906
4,848,543 A * 7/1989 Doboze ..... 220/4.23
5,273,174 A * 12/1993 Fisher ..... 220/4.21
5,423,477 A 6/1995 Valdman et al.
5,735,454 A * 4/1998 Jensen ..... 229/123.1
6,491,214 B1 12/2002 Plummer et al.

* cited by examiner

*Primary Examiner*—Gary E. Elkins
(74) *Attorney, Agent, or Firm*—Frank H. Foster; Kremblas, Foster, Phillips & Pollick

(57) ABSTRACT

A food enclosing container that has a top member and a bottom member, each formed of absorbent, corrugated paperboard, wherein at least one of the members has press-formed sidewalls. The paperboard has at least three layers, a smooth first layer, a smooth third layer and a corrugated layer interposed between the first and third layers. The top member has an unsealed interior surface so that it can absorb moisture from a contained food product. The bottom member has a grease barrier layer within the interior of its paperboard preferably positioned on the top surface of the third layer. Each of the members have engageable peripheral rims, which have a releasable, rebondable cohesive applied to the rims to permit the members to be bonded together, separated and rebonded together.

7 Claims, 3 Drawing Sheets

FOOD ENCLOSING CONTAINER WITH REBONDABLE RIM AND LIQUID ABSORPTION AND BARRIER LAYERS

BACKGROUND OF THE INVENTION

1. Field of the Invention

This invention relates generally to thermoformed, paperboard food containers, and more particularly to two part food containers which entirely enclose a prepared food product, maintain the quality of the food product and the appearance of both the food product and the container, while permitting the container to be reused multiple times for storing unconsumed portions of the food product.

2. Description of the Related Art

Many food containers, including those that hold pizza, are commonly made to be disposable after use for one food product. For example, pizza boxes are typically made from conventional, corrugated paperboard such as the pizza box illustrated in U.S. Pat. No. 4,441,626 to Hall, which discloses a pizza box formed from a double-sided corrugated blank. Other food containers, such as plates, bowls, clamshells and trays, are thermoformed or pressformed from relatively thin corrugated paperboard material such as the material described in U.S. Pat. No. 6,491,214 to Plummer, et al., which is herein incorporated by reference.

A pizza or other hot food product is placed inside the container or box and picked up by or delivered to the customer. The customer consumes some or all of the food and eventually disposes of the container in the trash. When less than all the food is consumed, the remaining food product is replaced in or remains in the container and is stored in the refrigerator.

Although these prior art container products have provided a substantial improvement over prior technology and have given good service to consumers, they continue to exhibit some deficiencies or undesirable characteristics.

Many of these containers have a fluid impervious layer or coating on one or more interior surfaces, most commonly a bottom, interior surface. This coating assists in maintaining the integrity of the container and resisting the transmission of fluids from the food products through the container material to present a distasteful, soiled external appearance to the container. However, the same coating on the bottom, interior surface also allows grease and other liquids, which are exuded from the food product, to pool on the impervious surface some of which soaks back into the food product. As a consequence, the food product becomes unpleasantly greasy and is seen by the consumer to be resting on an undesirably greasy surface.

If, instead, no liquid impervious layer is applied to the bottom surface, exuded grease, juices and moisture soak through the container bottom where they cause the container to exhibit a soiled appearance and can even stain an underlying tablecloth or other supporting surface. Some commercial establishments use an additional tray insert or soaker pad, which is typically a circular, corrugated disk placed on the interior bottom of the box to absorb or contain these exuded liquids. However, this adds further supply cost, consumes additional material and requires additional assembly time and labor.

Additionally, in the absence of a moisture impervious layer, the bottom can become soaked with liquids from the food product and become weakened and flimsy. The loss of sufficient rigidity makes the container, when held by the consumer, more likely to separate and tear or deform and allow the food product to spill out of the container.

When the container top is provided with a moisture impervious layer on its interior surface, moisture can condense from water vapor evaporated from the contained food product, collect into droplets instead of soaking into the container material and rain down onto the food product. This causes the top of the food product to become undesirably soggy in appearance and texture.

Conventional pizza boxes also require labor to assemble which adds to the cost and time for production of the final, deliverable product. Once assembled, they require considerable space for storage while awaiting the insertion of a pizza because they do not efficiently nest or stack in a vertical column. The conventional pizza box also relies on the friction fit of the lid or top against the sidewalls of the bottom and does not always close properly or remain tightly closed to keep the pizza fresh. Another problem is that the traditional square pizza box is bulky and often difficult to fit into a refrigerator. Because it has a round product in a square container, the square container uses approximately 8–10% excess, wasted material. Because of their size and bulk, they can be difficult to dispose of.

The problem of preventing a pizza from sitting on exuded grease and other liquids, while preventing unsightly penetration of those liquids through to the exterior surface of the container, was solved in U.S. Pat. No. 5,423,477 to Valdman et al. by coating the interior surface of the bottom with a liquid impervious layer but providing raised projections or ridges to hold the pizza above interposed valleys into which the liquids drained.

Another proposed solution to the same problem is described in U.S. Pat. No. 4,441,626 to Hall. There, two corrugated cardboards are laminated together with a moisture resistant glue. However, this requires the use of two corrugated layers and the step of gluing them together. Hall describes how this also requires the additional set up time and step for running the corrugating machine in a "backward" direction. Consequently, the Hall proposal involves significant additional material and manufacturing time and effort.

Applicant has been told that a food container was test marketed that was made from two, oppositely facing, conventional paper plates that were bonded together around their engaging rims. However, the products were not commercialized because of their serious deficiencies and inadequacies. The plates were made from paper rather than corrugated paperboard and therefore they lacked sufficient rigidity and thermal insulation characteristics. As a result, the container formed in this manner was too flimsy to hold the contained product and the rim was so flimsy that it warped and consequently did not permit the adhesive to be properly and evenly applied. Because of the inadequate insulation provided by paper, this container did not maintain the temperature of the enclosed food product for a sufficiently long time and also allowed its exterior surface to become hot to the touch, possibly resulting in a burning sensation or injury to the consumer. The paper material was unscored prior to forming the paper plates, which caused bunching of the paper material and formed wrinkles in the product. The wrinkles in the rim surfaces did not allow for the smooth application of the bonding material used to bond the plates together. The bonding material was not resealable and was intended only for a one-time use, like a shrink wrap. Additionally, this container was produced with a grease barrier coating on the upper surface of the lower plate, which the bonding material did not strongly adhere to and, therefore, released from major portions the rim when the container was pulled apart to access the contained product. This breaking of the bond with the paper plate in many, but not all, places allowed the plates to be physically separated but caused the bonding material which did remain bonded to form strings when the plates were separated. This stringing of the bonding material made the plates incapable of being resealed and the long strings of bonding agent could then fall onto the contained food product. In addition, the film barrier, placed on the inside of the lower plate, did not allow for the absorption of grease or water vapor and therefore, the grease or condensed liquid would "pool" on the surface and be reabsorbed by the contained food.

Therefore, it is an object and feature of the invention to provide a food container, particularly for pizza, which has top and bottom components which more efficiently use less material than conventional pizza boxes and are nestable so they can be stacked in compact columns, which does not require assembly, except for quick closure to enclose the pizza and which provides a stronger seal around its entire periphery.

Another object and feature of the invention is to provide a container having a bottom that not only allows the container bottom to soak up exuded liquids and maximizes liquid wicking and storage volume within the container, but also has a liquid barrier layer that prevents penetration of those liquids so that they do not cause an unsightly external container appearance.

Another object and feature of the invention is to provide top and bottom portions of the container that can be easily and strongly bonded together by a cohesive which is releasable and rebondable so the container can be reused for storing food products, that allows the top and bottom be used as two serving plates and that can be easily disposed of when no longer needed.

A further object and feature of the invention is to provide a container having a top that does not have a moisture barrier on its interior surface so the top can absorb moisture from the contained food product.

Another object and feature of the invention is to provide a food container, especially for pizza, which is made from thermoformed or pressformed corrugated material so that the container will be sufficiently rigid, can be manufactured at reduced cost, will provide thermal insulation, and will allow the top and bottom to be manufactured using the same die set.

BRIEF SUMMARY OF THE INVENTION

The invention is a food enclosing container that has a top member and a bottom member, each thermoformed of absorbent, corrugated paperboard, wherein at least one of the members has sidewalls. The top member has an unsealed interior surface so that it can absorb moisture from a contained food product. The bottom member has a grease barrier layer within the interior of its paperboard layer. Each of the members have engageable, peripheral rims, which have a releasable, rebondable cohesive applied to the rims to permit the members to be bonded together, separated and rebonded together.

Figure 1:
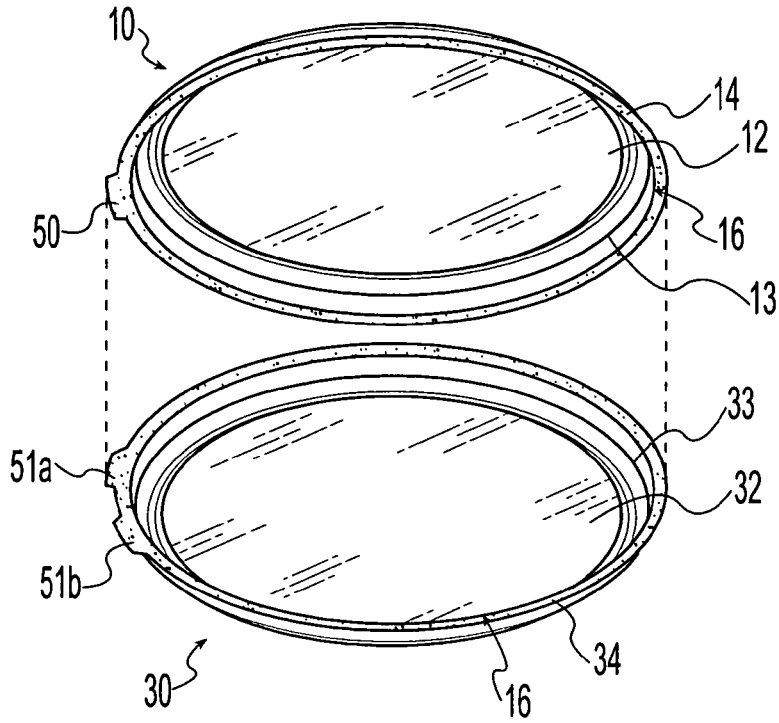
FIG. 1 is a view in perspective illustrating the separated top and bottom components of the preferred embodiment of the present invention.
Figure 2:
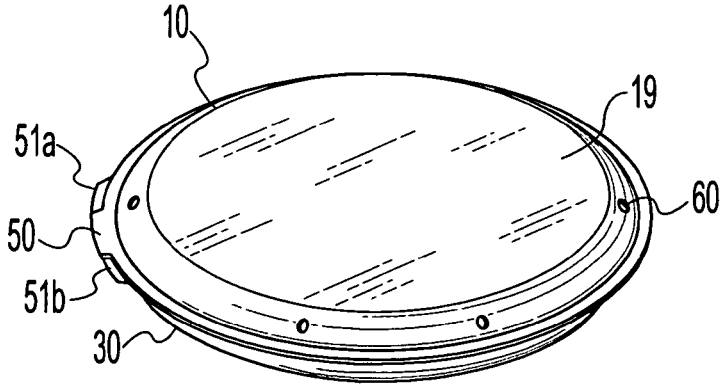
FIG. 2 is a view in perspective illustrating the embodiment in FIG. 1 with the components closed and releasably bonded together.
Figure 3:
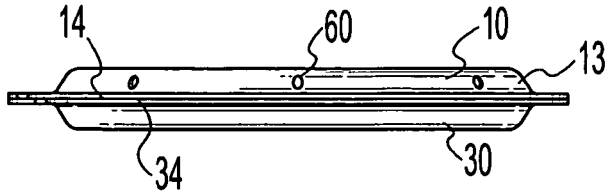
FIG. 3 is a view in side elevation illustrating the embodiment in FIG. 1 joined together as in FIG. 2.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents, which operate in a similar manner to accomplish a similar purpose. For example, the word connected or term similar thereto is often used. They are not limited to direct connection but include connection through other elements where such connection is recognized as being equivalent by those skilled in the art.

DETAILED DESCRIPTION OF THE INVENTION

The preferred embodiment of the present invention is illustrated in FIGS. 1–6. The invention is a food enclosing container that is principally intended for pizza but can be used for a variety of food products, including restaurant carryout orders and fast food products.

The food enclosing container has a top member 10 and a bottom member 30, each formed of absorbent, corrugated paperboard having at least three, laminated layers. Importantly, with the invention, neither interior surface of the top and bottom members have a moisture impervious layer on them. In the preferred embodiment, the top member 10 and the bottom member 30 are pressformed into trays having respective sidewalls 13 and 33 and having a circular periphery, which conforms to the shape of a conventional pizza. In an operable orientation, the peripheral rims 14 and 34 of the top 10 and bottom 30 members are engageable with one another. To achieve the operable orientation, the top member 10 is rotated so its interior opens downwardly and its flat exterior surface faces upwardly. The top member 10 is then placed directly above the bottom member 30 and lowered to engage the rims 14 and 34.

A cohesive 16 is bonded to the engageable surfaces of each of the rims 14 and 34. The cohesive releasably adheres, and preferably seals, the top and bottom members 10 and 30 together along the rims and also permits them to be opened, closed and readhered multiple times, making it easy to store leftover food products and to keep the leftovers fresh. A cohesive is an adhesive that only sticks to a cohesive surface, most commonly to another layer of itself. These are commercially available formulations and the cohesive composition is not a feature of the present invention. In typical applications, a cohesive is applied and bonded to surfaces on two objects, such as packaging bands and tape, and the objects can be bonded together by bringing their cohesive layers into contact. In the present invention, the cohesive is applied in a liquid form, bonds to the rims of the bottom and top members of the container and dries, cools or cures to a solid or plastic state. Because it is a cohesive, the bottom and top members can be nested in stacks and, because the underside of each rim has no cohesive, the individual items in the stack will not adhere to each other.

Commercially available cohesives are also available which are releasable when the adhesive bond to the surface to which they are applied and the cohesive molecular bonds within the applied cohesive are stronger than the bond between the dried or cured cohesive surfaces which were brought into contact. When applied to thermoformed paperboard container members, these properties make a container separable, rebondable and resealable. The preferred cohesive is a natural latex cohesive available from any number of adhesive manufacturers. For example, the currently preferred cohesive is product number 60CX13472 sold by Chemionics Corporation. In the preferred embodiment it is applied at the rate of approximately 5 to 20 dry pounds per ream (3000 square feet) depending upon the amount of adhesion desired.

The top member and the bottom member of embodiments of the invention are thermoformed in a conventional manner known to those skilled in the art. Thermoforming involves pressing the thin, corrugated material between two mating dies at a high pressure and applying some heat. The corrugated material has strategically placed scores so that wrinkles are not formed on the surface. This results in a top and bottom member which are relatively smooth as compared to an unscored container. Also, they are more rigid because of the corrugations and contoured shape and have much better insulative properties because of the small air spaces on opposite sides of the corrugated interior layer. Because the interior surfaces of the top and bottom members have no impervious layer on them, the cohesive is able to adhere more strongly to the top and bottom rims of container embodying the invention. Additionally, because the top and bottom members are made of corrugated material, the rims and any sidewall are more rigid and therefore make uniform application of the cohesive to the rims more easily accomplished.

Figure 4:
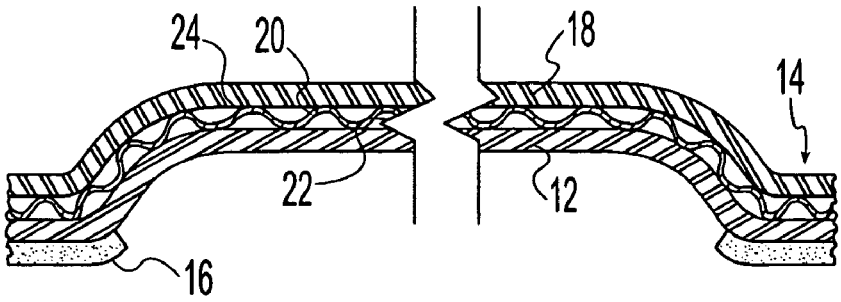
FIG. 4 is a cross-sectional view illustrating in more detail construction of the top member of the embodiment in FIG. 1.
Figure 5:
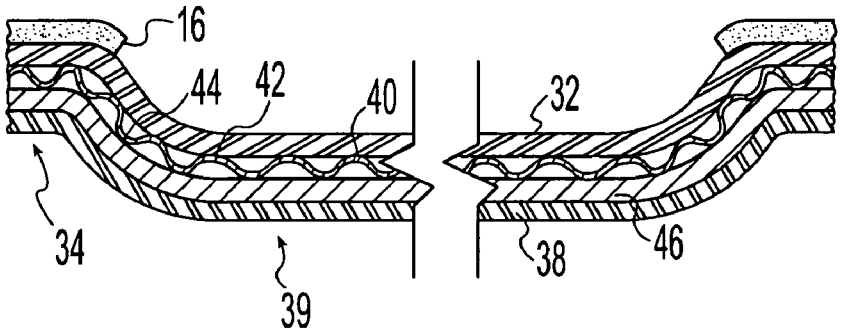
FIG. 5 is a cross-sectional view illustrating in more detail the construction of the bottom member of the embodiment in FIG. 1.

The structures of the top and bottom members 10 and 30 are illustrated in more detail in FIGS. 4 and 5. The layers of the corrugated paperboard from which they are made are exaggerated in size in order to illustrate these relatively thin layers.

Referring to FIG. 4, the paperboard of the top member 10 includes (a) a first, paper interior layer 12, which faces the food product when in an operable orientation; (b) a corrugated paper layer 20; and (c) a third, exterior paper layer 18 that, when in an operable orientation, is closest to the outside environment.

The interior layer 12 is unsealed, meaning that no fluid impervious layer is bonded to this smooth paper layer. Therefore, the entire top member 10 can absorb moisture from a contained food product. A typical food product, such as hot pizza, evaporates water vapor when enclosed in a container. The interior layer 12 absorbs the excess water vapor produced by the pizza. If the water vapor is not absorbed, it will condense on the first layer 12 and will rain or drip down onto the pizza or the bottom member 30. If the condensed water vapor rains on the pizza it will become soggy, which is undesirable to the customer.

The corrugations of the corrugated layer 20 have alternate ridges 22 and troughs 24, which are spaced apart to create air pockets These air pockets existing in the thermoformed paperboard not only provide the previously recognized insulation characteristics but can also provide moisture-containing pockets or reservoirs within the thermoformed layer. The condensed water vapor from the contained food product is wicked through the first layer 12 by capillary action and is absorbed into the corrugated layer 20 and can collect in the pockets of the corrugated layer 20, which prevents the absorbed water vapor from over saturating the first layer 12.

The third, exterior layer 18 is a smooth paper layer that, while not preferred, can have a fluid impervious coating on its exterior surface to prevent moisture from entering the top member 10 from the outside environment. Such a coating prevents the top member from getting soggy when carrying the container in the rain or in circumstances where a fluid, such as soda, is spilled on the top member 10.

In addition, the top member 10 has a plurality of openings 60 (shown in FIG. 2) placed in the sidewall 13 near the horizontal flat bottom 19 of the top member 10 to allow water vapor from the hot pizza to escape prior to condensing inside the container. The openings 60 preferably are circular, but can be any shape for use in venting the container. The number of openings 60 may also vary from the preferred six openings 60 to more or fewer openings, if desired.

Figure 10:
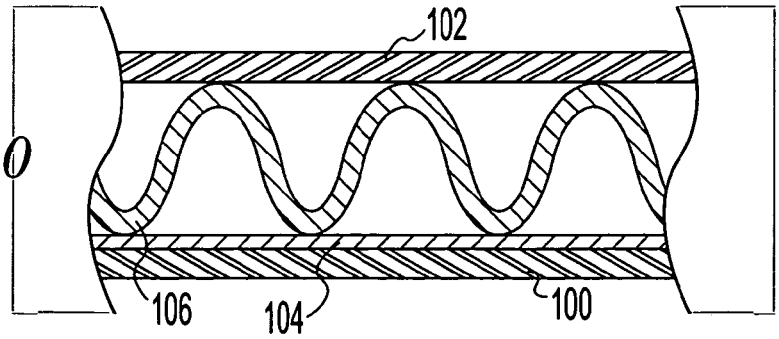
FIG. 10 is an enlarged cross-sectional view illustrating an alternative embodiment of the top member of an embodiment of the invention having a liquid barrier layer.

In an alternative embodiment of the top member, illustrated in FIG. 10, a fluid impervious barrier layer 104 may be placed between the third layer 100 and the corrugated layer 106. This moisture barrier layer 104 is another way to keep environmental moisture from penetrating the top member and also preventing the top member from appearing wet from condensed moisture while still allowing the top member to absorb moisture condensed on its interior surface. Of course, a person of ordinary skill in the art will recognize that the barrier layer 104 can be in a variety of locations within the paperboard. However, any fluid impervious layer should not be formed on the interior surface of the first layer 102, the layer closest to the food product, because this layer is for absorbing water vapor.

Figure 6:
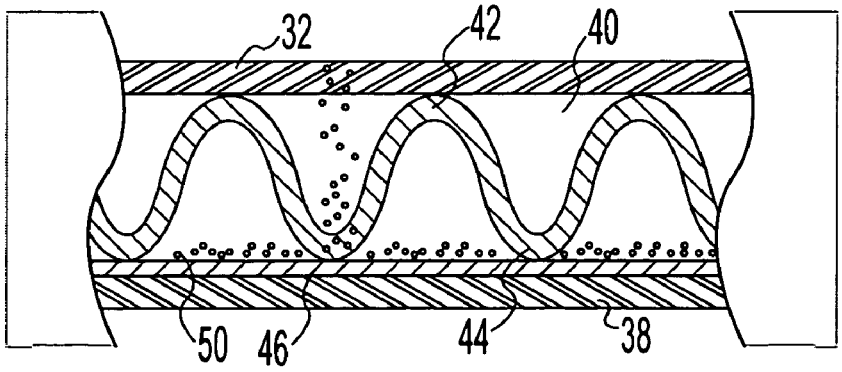
FIG. 6 is an enlarged cross-sectional view illustrating the bottom member of the embodiment in FIG. 1.

Turning now to FIG. 5 to describe the preferred bottom member 30 in more detail, the paperboard of the bottom member 30 has (a) a first, paper interior layer 32, the layer that is near the food product when in an operable orientation (see FIGS. 5 and 6); (b) a paper corrugated layer 40; (c) a grease barrier layer 46; and (d) a third, exterior paper layer 38 that, when in an operable orientation, is at the bottom of the container, closest to the outside environment, and commonly rests upon a support surface.

The interior layer 32 of the bottom member 30 is unsealed, meaning that this layer has no impervious layer on its interior surface and can absorb grease from the contained food product. Because there is no fluid impervious layer bonded to this surface, of the paper layer, the grease from the contained food product is wicked through the first layer 32 by capillary action and is pulled through to the next layer in the paperboard.

The corrugated layer 40 is the next layer, which helps in the absorption of grease. The corrugations of the corrugated layer 40 are not joined at all positions to the first layer 32, but has troughs 44 and ridges 42, which are spaced apart to create grease and juice containing pockets. The grease is absorbed into the corrugated paper layer 40 and collects also in the pockets where the grease 50 can pool but can penetrate only as far as the grease barrier layer 46.

The grease barrier layer 46 is a grease impervious layer, typically a polymer film bonded to the paper surface within the paperboard laminate. This grease barrier layer 46 prevents grease from wicking all the way through the paperboard bottom member and causing a soiled, greasy external appearance. It is preferred that the grease barrier layer 46 be located below the corrugated layer 40 because the corrugated layer 40 also functions as an absorption layer (see FIGS. 5 and 6). There can be additional paper layers in the paperboard from which the bottom member 30 is formed. It is most preferred to have the grease barrier layer 46 bonded to or coated upon the top or upper surface of the lowermost, exterior layer 38 of the bottom member 30 in order to provide the maximum absorption volume while still preventing a soiled appearance when the bottom external layer is viewed.

The third, exterior layer 38 is a smooth paper layer that, while not preferred, can also have a fluid impervious coating on its exterior, bottom surface to prevent moisture from entering the bottom member 30 from the outside environment. Such a coating prevents the bottom member 30 from getting soggy when carrying the container in the rain or if the container is set upon a wet support surface.

In the preferred embodiment, the grease barrier layer 46 is made of a water based acrylic coating that will allow good bonding to the corrugating adhesive. Of course, there are many suitable fluid impervious coating materials that can be used as will be recognized by a person of ordinary skill in the art. The grease barrier layer preferably has a composition and is applied in a manner that is substantially the same as impervious layers which have previously been applied to external surfaces of paperboard food containers.

Referring to FIG. 6, the placement of the grease barrier layer 46 within the bottom member 30 in the preferred embodiment allows excess grease 50 from the pizza to be wicked away from the surface of the interior layer 32. Through capillary action the grease 50 is pulled through the interior layer 32 and the corrugated layer 42 of the bottom member 30 to the barrier layer 46, which blocks the grease from wicking through to the bottom exterior layer 38 of the bottom member 30. This keeps the grease from seeping through the bottom member 30, unlike traditional pizza boxes, which allow grease to penetrate to the bottom and be transferred to clothing or car seats. Additionally, the interior layer 32 is aesthetically acceptable to the consumer, because the excess grease is neither pooled on the surface near the pizza nor externally visible on the bottom.

Figure 7:
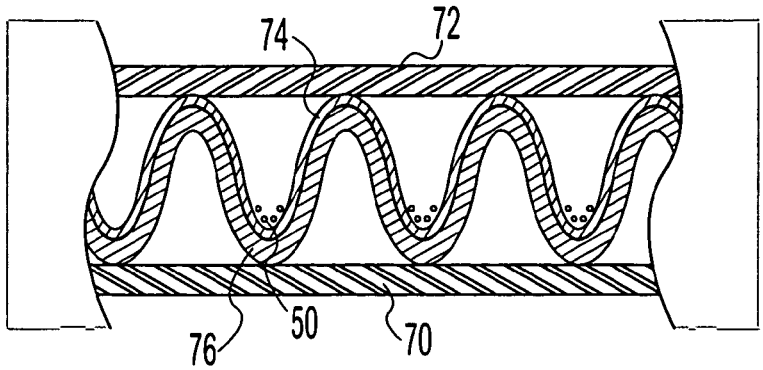
FIG. 7 is an enlarged cross-sectional view illustrating an alternative placement of the liquid barrier in a bottom member of an embodiment of the invention.

Since multiple layers make up the paperboard of the bottom member, the grease barrier layer can be placed in alternative, less desirable positions and still accomplish the objects and advantages of the invention. For example, in a first alternative illustrated in FIG. 7, the grease barrier layer 74 may be placed along the upper surface of the corrugated layer 76. This placement allows the grease 50 to be absorbed in the first layer 72 and also wicked through the first layer 72 and become trapped in the pockets between the corrugated layer 76 and the first layer 72.

Figure 8:
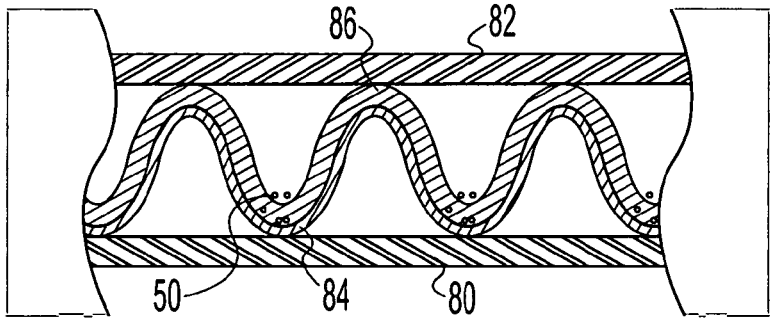
FIG. 8 is an enlarged cross-sectional view illustrating another alternative placement of the liquid barrier in a bottom member of an embodiment of the invention.

In a second alternative illustrated in FIG. 8, the grease barrier layer 84 may be placed on the undersurface of the corrugated layer 86, which is between the corrugated layer 86 and the exterior, third layer 80. In this embodiment, the grease 50 is wicked through the interior, first layer 82 to the corrugated layer 86 and is also absorbed in the corrugated layer and trapped in the pockets between the first layer 82 and the corrugated layer 86.

Figure 9:
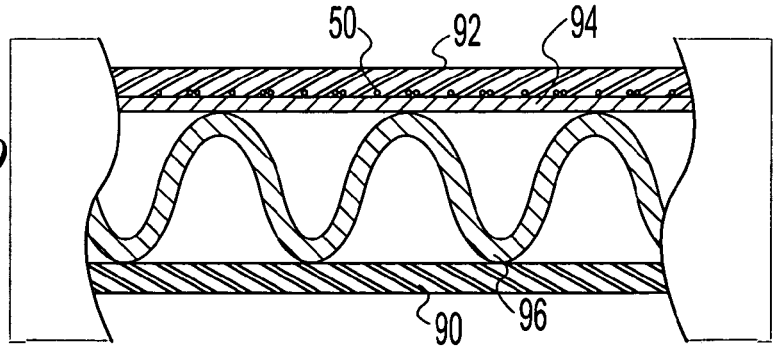
FIG. 9 is an enlarged cross-sectional view illustrating yet another alternative placement of the liquid barrier of a bottom member of an embodiment of the invention.

In a third alternative illustrated in FIG. 9, the grease barrier layer 94 may even be placed above the upper surface of the corrugated layer 96 and below the first layer 92. Although not preferred, in this embodiment the grease 50 is still wicked away from the surface holding the pizza. Each of the above alternatives prevents the grease from wicking through to the third, exterior layer of the bottom member, while absorbing the grease from the contained food product. A person of ordinary skill will recognize that there are many alternative placements of the grease barrier layer, particularly if additional paper layers are added to the basic three layer paperboard.

The portions of the blanks which become the rims 14 and 34 are scored or have creases incorporated in the paperboard material before being thermoformed so that the rim surfaces are smooth and flat. The smooth, flat surface allows a rebondable, releasable cohesive 16 to be applied smoothly and evenly to each of the rims 14 and 34. Because the interior surface of both the top and bottom members are unsealed, the surfaces of the rims 14 and 34 are unsealed, which enables the cohesive 16 to bond strongly to the rims 14 and 34 making it less susceptible to release from the rim surfaces. The cohesive 16 is rebondable so that the top member 10 and the bottom member 30 can be bonded together, separated and rebonded together multiple times. It is preferred that the cohesive 16 also have sealing qualities wherein the cohesive 16 forms a seal between the top member 10 and the bottom member 30. However, it is not necessary for the cohesive 16 to form a complete seal.

In the preferred embodiment, the top member 10 has a tab 50 that registers between two tabs 51*a* and 51*b* on the bottom member 30 when the two members are brought together. The tabs 50, 51*a* and 51*b* provide convenient finger grippable handles to assist the user in separating the top member from the bottom member when opening the container.

There are many advantages to the food enclosing container of the preferred embodiment. In a typical pizza box, some assembly is required. The user of the box begins with flat box material and must fold along perforations to create the box. This sometimes includes making multiple folds along the box pattern, which is time and labor intensive in the fast paced pizza retail delivery market. Additionally, storage becomes an issue for pizza boxes that are not stackable or nestable once assembled. The preferred embodiment of the invention minimizes storage because the top and bottom members 10 and 30 are substantially similar and therefore are nestable and stackable. Additionally, no assembly of the container is necessary prior to placing the food product or pizza inside the preferred embodiment.

To use the preferred embodiment, the pizza is placed in the bottom member 30 and can be cut right inside the bottom member 30, which is not usually the case in a traditional pizza box. Once the pizza is cut, the top member 10 is placed on the bottom member 30, wherein the top rim 14 engages the bottom rim 34 and the rims 14 and 34 are pressed together, which bonds and seals the cohesive 16, thereby closing the container. The assembly is finished, and the pizza is ready to be delivered or served to the customer.

In the preferred embodiment, both the top member 10 and bottom member 30 can be formed from the same matched male/female die set (such as described in U.S. Pat. No. 6,491,214). This saves tooling costs and results in a top and bottom member which have identically shaped sidewalls and central portion joining the sidewalls but still allowing the rims to come into engagement. The peripheral edges of the rims may extend outwardly by different distances and have different boundary contours, such as different tabs by using different planar blanks in the thermoforming operation. The preferred paperboard is e-flute corrugated material made from solid bleached linerboard, which has an inherent rigidity to remain functional even after absorbing moisture throughout its useful life. Of course, the top and bottom members 10 and 30 can be thermoformed from a variety of suitable materials into a variety of other shapes including oval, square, octagonal, rectangular or triangular. In addition, the multiple layers of the paperboard give the container insulation properties, which reduce the potential for someone getting burned by holding the container with hot contents inside, and assist in keeping foods at their serving temperatures for longer periods of time. Furthermore, the preferred paperboard material is more environmentally friendly when disposed of than the typical expanded polystyrene foam containers currently used in the fast food retail chains.

Additionally, if either the top member or the bottom member is formed as a sufficiently deep tray to contain the enclosed food product, the other member, most practically the top member, can be planar or domed.

While certain preferred embodiments of the present invention have been disclosed in detail, it is to be understood that various modifications may be adopted without departing from the spirit of the invention or scope of the following claims.

What is claimed is:

1. A food enclosing container, in an operable position comprising:

a. a top member and a bottom member, the members being thermoformed of absorbent, corrugated, laminated paperboard, including an exterior layer, an interior layer and an interposed corrugated layer, at least one of the members having sidewalls, each member having a peripheral rim, the rims being engagable;

i. the top member having an unsealed interior surface so that it can absorb moisture from a contained food product;

ii. the bottom member having an unsealed interior surface and a grease barrier layer within the interior of its paperboard; and b. a releasable, rebondable cohesive adhered to engageable surfaces of said rims to permit the members to be releasably bonded together, separated and rebonded together by contact.

2. The food enclosing container in accordance with claim 1, wherein said grease barrier layer is laminated to the upper surface of the exterior layer of the bottom member within the paperboard.

3. The food enclosing container in accordance with claim 1, wherein said grease barrier layer is laminated to the corrugated layer of the bottom member within the paperboard.

4. The food enclosing container in accordance with claim 1, wherein both of said members have pressformed sidewalls.

5. The food enclosing container in accordance with claim 4 and further comprising a plurality of openings in the sidewall of the top member to allow moisture to escape prior to condensing inside the container.

6. The food enclosing container in accordance with claim 4 wherein the top and bottom members which have identically shaped sidewalls and central portion.

7. The food enclosing container in accordance with claim 6, wherein said rim of the top member is engaged with said rim of the bottom member in an operable orientation to form the container.

* * * * *